United States Patent [19]

Turner

[11] 4,208,644

[45] Jun. 17, 1980

[54] ENERGY REGULATOR

[75] Inventor: Norman J. Turner, Tauranga, New Zealand

[73] Assignee: Actrol Industries Pty. Ltd., Melbourne, Australia

[21] Appl. No.: 924,284

[22] Filed: Jul. 13, 1978

[51] Int. Cl.[2] ..... H01H 61/02

[52] U.S. Cl. ..... 337/102; 337/353; 337/361

[58] Field of Search ..... 337/102–105, 337/353, 361–363, 27, 333, 349

[56] References Cited

U.S. PATENT DOCUMENTS

| | | | |
|---|---|---|---|
| 3,587,023 | 6/1971 | Goessler et al. | 337/103 |
| 3,943,479 | 3/1976 | Turner | 337/361 X |

*Primary Examiner*—R. L. Moses

*Attorney, Agent, or Firm*—Graybeal & Uhlir

[57] ABSTRACT

An electrical energy regulator of the kind including an electrically energizable heater which, when energized, causes deflection of a bi-metal actuator which in turn influences operation of switch means. The switch means controls supply of electrical energy between input and load terminals which are respectively connected, when in use, to a power source and power using means. The switch means includes two heater contacts which must be closed to enable energization of the heater, and two control contacts which must be closed to enable connection of the input and load terminals. The switch means also includes a spring blade which is connected to the input terminal and carries one of the heater contacts and one of the control contacts. The blade is movable between two operative conditions in which the heater contacts are open and closed respectively, and the control contacts are closed and open respectively. A lever movable about an adjustable fulcrum responds to movement of the bi-metal to thereby cause a change in the spring blade operative condition. A rotatable cam is operative to adjust the fulcrum to vary the amount of bi-metal movement necessary to cause a change in the operative conditions of the switch means, and also regulates an auxiliary switch in the connection between the spring blade and the input terminal.

15 Claims, 6 Drawing Figures

ENERGY REGULATOR

This invention relates to thermally actuated energy regulators of the kind used in electric circuitry. Such regulators are commonly used for controlling energization of heating devices or units such as the heating elements of an electric range, and it will be convenient to hereinafter describe the invention in relation to that example application.

Thermally controlled energy regulators have been known and used for many years. Generally, such regulators include a bi-metal actuator in the form of a strip or arm which flexes or bends in response to changes in temperature of an associated heater device, and is operatively connected to a switch so as to control opening and closing of the contacts in accordance with heat output of the associated heating device. Such regulators, also sometimes referred to as infinite switches or simmer controls, provide a means for controlling the amount of electrical energy supplied to a load, usually a heating element such as a hot plate of an electric cooker, over a desired range. That control is achieved, at all settings over the range concerned, by intermittently opening the switch and thereby interrupting the supply of electric energy to the hot plate. Selection of a particular setting is effected through adjustable means such as a cam which determines the amount of work the bi-metal actuator must perform to open the switch contacts.

Energy regulators of the aforementioned kind are generally arranged so that the heater device is energized in order to cause the regulator to operate to disconnect the power supply to the hot plate, or whatever load is involved. That is, the heater device is "on" as the hot plate approaches the preselected temperature, and at that temperature the heater device causes the bi-metal to deflect such as to open the contacts through which power is supplied to the hot plate. The consequence of that arrangement is that, in the event of failure of the heater device, the hot plate remains connected to the power supply and thereby proceeds to a "full on " condition. That characteristic has been known to cause fires, and at least presents a high risk of damage to the equipment associated with the regulator—e.g., cooking utensils being heated by a hot plate.

It is a principal object of the present invention to provide an energy regulator of the kind indicated having a fail-safe facility such as to overcome the danger referred to above.

A feature of a regulator according to the invention is that the heater device is energized in the contact open condition only, and when energized it functions to deflect the bi-metal so as to urge the control contacts into a closed condition. Consequently, energy is not supplied through the regulator when the heater device is not energized, and failure of that device will result in power being disconnected from the hot plate. The fail-safe concept may be incorporated into regulators of various constructions, but it will be convenient to hereinafter describe the invention as applied to one particular form of regulator which is suited for use in controlling energy supply to cooking hot plates.

In one aspect, the invention provides an electrical energy regulator including; a body section; an actuator attached to said body section and having a heater associated therewith, part of said actuator being movable relative to the remainder thereof in response to energization of said heater; switch means secured to said body section and including heater contacts and control contacts, said switch means being operable such that said heater is energizable only in an open condition for said control contacts; means acting between said actuator and said switch means and being movable in response to said movement of the actuator and to thereby cause actuation of said switch means; and cam means movably mounted on said body section and being operable to adjust said means acting between said actuator and said switch means to thereby alter the amount of movement of said actuator part necessary to cause actuation of said switch means to bring said control contacts into a closed condition.

In a further aspect, the invention provides an electrical regulator including a body section; an actuator attached to said body section and having a heater associated therewith, part of said actuator tending to deflect any response to energization of said heater; switch means secured to said body section in predetermined relation to said actuator, said switch means including heater contacts and control contacts, said switch means being operable such that said heater is energizable only in an open condition for said control contacts; lever means acting between said actuator and said switch means and being responsive to pressure applied thereto by said actuator part to cause actuation of said switch means; said lever means reacting against a fulcrum when said pressure is applied thereto; and cam means movably mounted on said body section and being operable to adjust the position of said fulcrum relative to said actuator and to thereby alter the pressure necessary between said actuator and said lever means to cause actuation of said switch means.

The switch means may include a respective heater and control contact fixed to the body section and a respective movable heater and control contact carried by one end portion of a spring member, the other end portion of the spring member being secured to the body section. The means acting between the actuator and the switch means in such case engages the spring member intermediate the end portions so as to influence the relative positions of the contacts. The spring member may have a finger section partially separated from the body thereof and disposed intermediate the sides and ends thereof, the finger extending in the general direction between the end portions and being stressed to normally urge the movable heater contact into engagement with the fixed heater contact; the actuator being operative through energization of said heater and resulting movement of the means acting between the actuator and switch means, to separate said heater contacts and urge the movable control contact into engagement with the fixed control contact.

Said finger section most conveniently is integral at one end thereof with the body of said spring member at the other end portion. A further finger section partially separated from the body thereof of the spring member may be provided, the further finger extending in the general direction between the end portions and being integral at one end thereof with the body of said spring member at the one end portion. In such case, the other ends of the finger preferably are spaced in the direction the fingers extend and carrying therebetween a spring loop which stresses the first-mentioned finger toward the body section and thereby flexes said one end portion of the spring member away from said body section to urge said movable heater contact into engagement with the fixed heater contact.

The means acting between said actuator and said switch means may be a lever movable about a fulcrum in response to movement of the actuator. In such case, the cam means may be operable to adjust the position of the fulcrum relative to the actuator to thereby alter the amount of movement of the actuator part necessary to cause actuation of the switch means. Said lever means may include a lever engaging both the movable part of the actuator and the switch means at respective opposite end portions thereof, and the fulcrum is located intermediate the end portions. In one form, the fulcrum is formed separate from said lever and is attached to said body section for relative movement thereto under the influence of the cam means. A cam follower may be connected to said fulcrum and engages a cam surface of the cam means, whereby movement of the cam follower as influenced by the cam surface causes corresponding movement of the fulcrum.

The actuator may comprise a bi-metal member having two laterally spaced arms interconnected by a bridge portion at one end; the bridge portion and the remote end of one arm being attached to the body section; the other arm forming the movable part of the actuator, and the movement thereof results from flexing about the bridge portion attachment. Said bridge portion most conveniently is attached to the body section in a fixed position relative thereto, and the end attachment of said one arm includes adjustable means whereby the position of the remote end relative to the body section can be varied. The adjustable means may comprise a calibrating screw.

Where the switch means includes a spring member on the one end of which the movable heater and control contacts are mounted, the lever means may engage a projection extending from one face of the spring member so as to achieve substantially point contact between the lever means and the spring member.

The cam means may include a rotatable member having a cam surface defined by an end face thereof which extends transverse to the rotatable axis of the cam member. The cam member may be secured to the body section so as to be releasably attachable therewith to a support and/or control means. A mounting plate carrying a relatively rotatable spindle most conveniently is releasably secured to the body section, with abutment means attached to the spindle for rotation therewith engaging with complementary means of the cam member so that rotation of said spindle causes corresponding rotation of said cam member. The abutment means and the complementary means may automatically disengage upon separation of the mounting plate from the body section. The cam member may have a cam profile on a side surface thereof which is operable to influence an auxiliary switch.

In conventional regulators, the control contacts close when the regulator is switched to an "on" condition, and energy is thereby supplied to the hot plate. At the same time, the heater device is energized, and its temperature increases towards the temperature at which the bi-metal is deflected to open the contacts. That "de-energization" temperature is determined by the setting of the regulator within the range of adjustment in which an "on" condition is achieved, and as previously stated that setting is usually effected through a cam. When the control contacts open, power is automatically disconnected from the heater device so that it loses heat and as a consequence the bi-metal returns to its undeflected condition at which the contacts are again closed and energy is once more supplied to the hot plate. That cyclic operation continues until the regulator is switched to the "off" condition at which the cam "ramps" the bi-metal into a deflected condition at which the contacts are held open. U.S. Pat. No. 3,943,479 describes a regulator which operates in that fashion.

In a regulator according to the invention however, the heater device is energized while the control contacts are open, and that may be achieved in many different ways. In one form, one of the control contacts is movable and the other is fixed, and the movable contact is carried by a blade which also carries a heater switch contact. The blade is movable between two limit positions which correspond respectively to the heater "off" and "on" positions, and in the former position the contacts of the heater switch are open whereas the control contacts are closed. The bi-metal is arranged to normally urge the contact blade to the heater "on" position, and will deflect, under the influence of the energized heater, to close the control contacts and simultaneously open the heater switch. Power supply to the heater is regulated through an auxiliary switch which is open in the "off" condition of the regulator and closes only when the regulator is switched to an "on" condition.

To facilitate an understanding of the invention, reference is made to the accompanying drawings where these features are illustrated in a preferred form. It is to be understood however, that the essential and optional features are not limited to the specific forms of these features as shown in the drawings.

Figure 1:
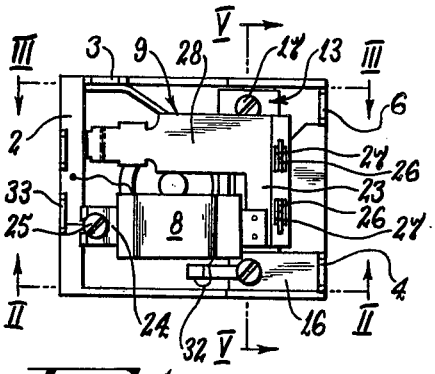
FIG. 1 is a plan view of one particular regulator made in accordance with the invention.
Figure 5:
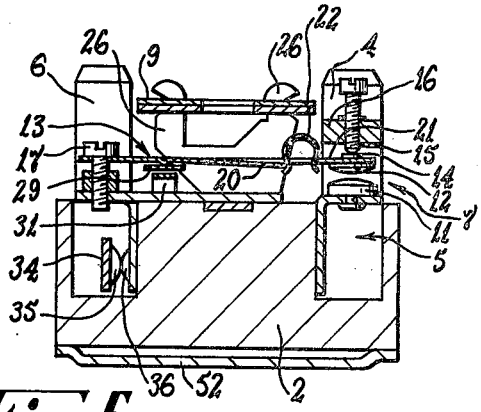
FIG. 5 is a cross-sectional view taken on line V—V of FIG. 1.
Figure 2:
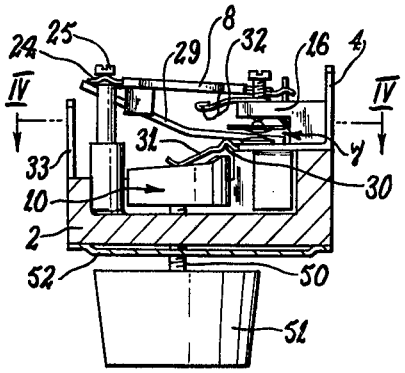
FIG. 2 is a cross-sectional view taken on line II—II of FIG. 1.
Figure 3:
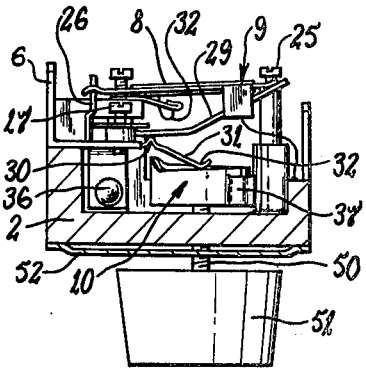
FIG. 3 is a cross-sectional view taken on line III—III of FIG. 1.
Figure 4:
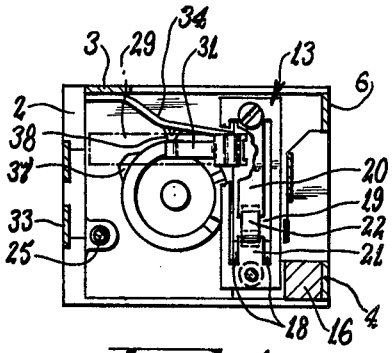
FIG. 4 is a cross-sectional view taken on line IV—IV of FIG. 2.
Figure 6:
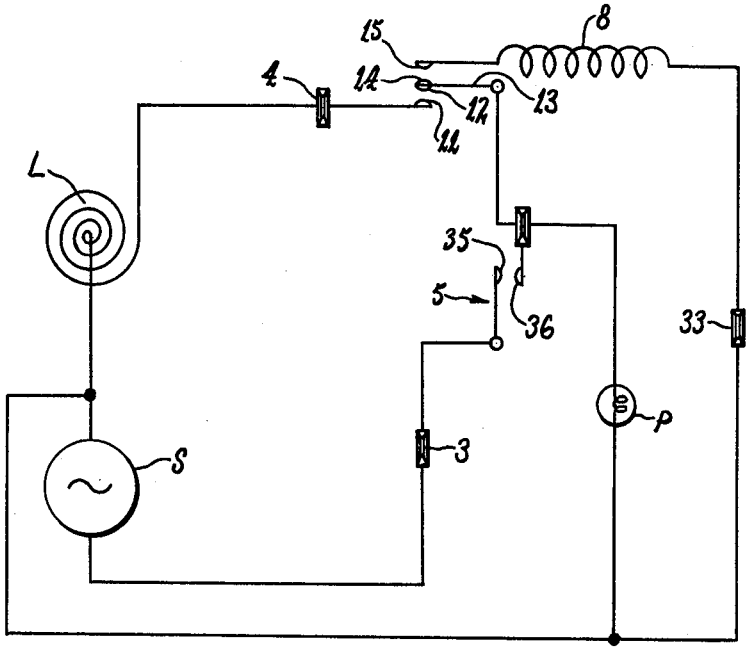
FIG. 6 shows an example circuit incorporating a regulator according to the invention.

The regulator shown in the drawings includes a main body 2 which supports a number of conductor terminals. The latter include an active terminal 3 for connection to the mains supply S and a load terminal 4 for connection to a load device or unit L (e.g. a heating element) to be energized through the regulator (see FIG. 6). The body 2 also carries a switch 5 for providing a connection between active terminal 3 and a pilot terminal 6, a thermally responsive switching system 7 for providing a connection, via switch 5, between the active and load terminals 3 and 4 or between the active terminal 3 and a heater 8. A bi-metal actuator 9, with which heater 8 is associated, also is carried on the body 2, as is adjusting means in the form of rotatable cam 10 which is arranged to control switch 5 and the thermally responsive switching system 7.

In the construction shown, switching system 7 includes control contacts 11 and 12. The contact 11 is a fixed contact secured to a terminal blade attached to body 2, in this instance the load terminal 4, so as to have a fixed position relative to that body. The contact 12 is mounted on one end of a movable contact blade 13, in this instance formed by a trident spring similar to that shown in U.S. Pat. No. 3,943.479.

The switching system also includes heater switch contacts 14 and 15. The contact 14 is a movable contact mounted on the same end, but the opposed side, of blade 13 as contact 12. The contact 15 is a fixed contact mounted on electrical insulated arm 16 secured on or integral with the body 2, adjacent pilot terminal 6.

It is preferred that the relationship between the spring blade 13 and the bi-metal actuator 9 is similar to that disclosed in the aforesaid U.S. patent; that is, the actuator 9 influences the spring blade 13 through a compensator level which rocks about a fulcrum, the position of which is controlled by the cam 10.

In the arrangement shown, the spring blade 13 is secured to the body 2 at its end remote from control contacts 11 and 12, as at 17. A feature of spring blade 13 shown in the drawings is that centre sections are partially separated from the main body of the blade; that partial separation being effected by two slots or cuts 18 formed through and extending longitudinally of the blade in laterally spaced relation and a transverse slot or cut 19 extending between slots or cuts 18. The slots 18 and 19 form boundaries of longitudinally spaced centre or finger sections 20 and 21 each integral at one end thereof with the main body of blade 13. Between the spaced, free ends of finger sections 20 and 21 there is retained a spring loop 22; the body of the latter being on the face of blade 13 remote from the regulator body 2. Due to that positioning of the loop 22 and the greater length of the finger section 20 compared with finger section 21, the loop 22 prestresses the free end of finger section 20 toward the body 2 and, hence, the blade 13 acts to force the movable control contact 12 out of engagement with fixed control contact 11 and the movable heater contact 14 into engagement with the fixed heater contact 15.

In the preferred construction shown, the bi-metal 9 and heater 8 are both formed as part of a "U" shaped assembly, the base 23 of which is mounted on the regulator body 2 so that the assembly is capable of rocking movement relative to that body. The coil of heater 8 is wound about one arm 24 of the assembly, and the end of that arm remote from the base 23 is attached to the regulator body through a calibration screw 25. The aforementioned rockable mounting is provided by two support members 26 upstanding from and secured to the body 2, each member 26 being notched near its terminal end so as to snap engage in aperture 27 of base 23 and facilitate adjustment of the operative position of the assembly through the calibration screw 25. The heater arm 24 is preferably made of bi-metal, and may be secured to the associated base 23 in any appropriate manner. The other arm 28 of the assembly is the control component in that its end remote from the base 28 acts on the aforementioned compensator lever 29 and thereby controls, by its movement relative to the assembly base 23, the opening and closing movement of switch system 7.

The compensator lever 29 is preferably located below the control arm 28—i.e. it is between that arm and the regulator body 2—and ideally extends in substantially the same general direction as the bi-metal arm. Opposite end portions of the compensator lever 29 engage the control arm 28 and the spring blade 13 respectively, and the aforementioned fulcrum 30 engages the lever 29 at a position between those end portions. The fulcrum 30 may be formed by a member 31 which is pivotally connected to the regulator body at one end, has a cam follower 32 at its opposite end, and has a hump or other projection between those ends which defines the fulcrum and engages the under surface of the compensator lever 29. The cam follower 32 engages the aforementioned cam 10, which is adjustable to vary the height of the fulcrum 30—i.e., vary the distance between the hump and the base of the bi-metal assembly—and thereby control the degree of movement of the control arm 28 necessary to cause closing of the control contacts 11 and 12. If desired, at least part of the compensator lever 29 may be formed as a bi-metal.

The cam is rotatable under the action of separable spindle 50 and knob 51. The spindle is secured in relation to the cam by cover plate 52; the latter being secured on body 2 by any suitable form of releasable retaining means.

As indicated, one end of the contact blade 13 is secured to the regulator body 2, and the movable contacts 14 and 12, respectively, of the heater and contact switches are carried by the opposite end portion of that blade. The fixed contact 15 of the heater switch is connected to one end of the heater coil through an electrically conductive wire 32, and the other end of the coil is connected to a neutral terminal 33 of the regulator. The active supply thus is connected to the heater circuit when the contact blade 13 makes engagement, via contact 14, with the fixed contact 15 of the heater switch. The compensator lever 29 preferably engages beneath the blade 13 at a position between ends of the latter so that upward movement of the blade end of the lever 29 urges the blade towards the position at which the control contacts 11 and 12 close, against the natural bias of the blade 13 which is such that the heater switch contacts are closed. Thus, in the arrangement shown, the lever 29 engages beneath finger section 20 such that upward movement of the blade end of lever 29 urges that finger section up and thereby results in downward flexing of the remote end of the blade 13 to move contacts 14 and 15 out of engagement and contacts 11 and 12 into engagement.

Biasing of the contact blade 13 can be achieved in any appropriate manner. By way of example only, the blade may be arranged substantially as shown in U.S. Pat. No. 3,943,479, but, as evident from the foregoing, having the reverse bias in that the blade is normally urged away from the fixed contact 12 of the control switch. The cam 10 may also be substantially as shown in the aforementioned U.S. patent, but the cam profile is reversed and a ramp section to hold the contact blade in the switch open position is not necessary, because the normal bias of the blade serves that purpose.

The auxiliary switch 5 may include a switch arm 34 connected at one end to active terminal 3 and carrying, at the other end a movable contact 35 engageable with fixed contact 36 on pilot terminal 6 or another active terminal so as to permit completion of both the heater circuit and the control switch circuit. That engagement may be controlled by a lobe 37 of the cam 10 which engages cam follower 38 to hold the auxiliary switch open in the "off" condition of the regulator. That lobe 37 need not be part of the normal cam track which controls the fulcrum position, but as shown it may be a lateral projection on the rotatable cam member. If desired, the auxiliary switch 5 may also control a pilot lamp P (see FIG. 6) which indicates when the regulator is in an "on" condition.

It will be appreciated from the foregoing that a regulator according to the invention has a valuable advantage of inherent safety when compared with prior regulators. At the same time, the regulator of the invention may incorporate all of the advantages of the regulator of the aforementioned U.S. patent, including the advantage of convenient and accurate calibration.

A further advantage of the regulator of the invention, is that the bi-metal actuator 9 and heater 8 do less work than in conventional regulators and therefore have a longer useful life. That results from the fact that the energization time of the heater 8 is controlled by a descending temperature-time curve rather than an ascending temperature-time curve. In that regard, during the heating of any body, the curve (which is an ascending curve) representative of temperature plotted against time, will rise rapidly in low temperature regions and flatten out in higher temperature regions as the heat losses more closely approximate the heat input. During cooling however, the temperature-time curve (which is a descending curve) falls sharply in the high temperature region and flattens out in the lower temperature region at which the rate at which heat is lost decreases because of the smaller temperature differential between the heated body and the surrounding environment. Thus, in the high temperature ranges, the time required to increase the temperature from one level to another is longer than the time required to drop from the higher to the lower level.

It follows that when the hot plate temperature is required to be in a higher temperature range, the regulator on-time will naturally be greater than if a lower hot plate temperature was required. The higher however, is energized only during off-time, which is the descending curve period, and consequently the bi-metal is subjected to the strain resulting from the conflicting influences of the heater and the spring blade, for a relatively short period of time. In fact, there is no energization of the heater, and consequently no strain on the bi-metal, when the regulator is at full-on position.

In conventional regulators however, the heater energization is controlled by an ascending temperature-time curve, since the heater is energized during the time the control contacts are closed. Consequently, the bi-metal and heater are subjected to greater periods of strain than in the regulator of the present invention. When a conventional regulator is at the full-on position, the bi-metal is maintained under maximum strain.

It will be understood that various alterations, modifications and/or additions may be incorporated into the foregoing without departing from the scope of the invention.

Having now described my invention, what I claim as new and desire to secure by Letters Patent is:

1. An electrical energy regulator including; a body section; an actuator attached to said body section and having a heater associated therewith, part of said actuator being movable relative to the remainder thereof in response to energization of said heater; switch means secured to said body section and having a pair of control contacts and a pair of heater contacts, said contact pairs being interconnected so that the contacts of one said pair are open when the contacts of the other said pair are closed, and vice versa; said switch means is connected to said actuator so that said contact pairs are caused to open and close in response to said movement of said actuator part; cam means movably mounted on said body section and being operable to influence the connection between said switch means and said actuator part to thereby alter the amount of movement of said actuator part necessary to cause conversion of said switch means from one operative condition in which said control contacts are open to another operative condition in which said control contacts are closed; and terminal means attached to said body section and being connectable to a power source; a first contact of each said pair of contacts is connected to said terminal means, the second heater contact is connected to said heater, and the second control contact is connectable to means for using power from said source.

2. A regulator according to claim 1 wherein said interconnection between said contact pairs includes a contact arm which is movable relative to said body section, each of said first contacts being secured to a respective opposite side of said arm for movement therewith, and both said second contacts are fixed to said body so that each is engageable by a respective one of said first contacts, the arrangement being such that said arm is movable between two positions which correspond to said operative conditions of the switch means and in each of which the contacts of a respective said pair are closed.

3. A regulator according to claim 2, wherein said contact arm comprises a spring blade having said first contacts secured to one end portion thereof and having its opposite end portion secured to said body section, and wherein connection between said switch means and said actuator part includes a member which engages said spring blade at a location between said end portions so as to influence the relative positions of said first and second contacts.

4. A regulator according to claim 3, wherein said spring blade has a finger section partially separated from the body thereof and disposed intermediate the sides and ends thereof, said finger extending in the general direction between said end portions and being stressed to normally urge the first heater contact into engagement with the second heater contact, and said actuator being operative through energization of said heater and resulting movement of said connecting member to cause separation of said heater contacts and cause the first control contact to be moved into engagement with the second control contact.

5. A regulator according to claim 4, wherein said finger section is integral at one end thereof with the body of said spring blade at said other end portion, and wherein said spring blade has a further finger section partially separated from the body thereof, said further finger extending in the general direction between said end portions and being integral at one end thereof with the body of said spring member at said one end portion, the other ends of said fingers being spaced in the direction said fingers extend and carrying therebetween a spring loop which stresses the first-mentioned finger toward said body section and thereby flexes said one end portion of the spring member away from said body section to urge said first heater contact into engagement with the second heater contact.

6. A regulator according to claim 1, wherein said actuator part and said switch means are connected through a lever which is movable about a fulcrum in response to movement of the actuator part, and said cam means is operable to adjust the position of said fulcrum relative to said actuator to thereby alter the amount of movement of said actuator part necessary to cause a change in the operative condition of said switch means.

7. A regulator according to claim 6, wherein opposite end portions of said lever engage said actuator part and said switch means respectively, and said fulcrum is located between said lever end portions.

8. A regulator according to claim 7, wherein said fulcrum is formed separate from said lever and is attached to said body section for movement relative thereto under the influence of said cam means.

9. A regulator according to claim 1, wherein said actuator comprises a bi-metal member having two laterally spaced arms interconnected by a bridge portion at one end; said bridge portion and the remote end of one said arm being attached to said body section; the other said arm forming said movable part of the actuator, and the said movement thereof results from flexing about said bridge portion attachment.

10. A regulator according to claim 6, wherein said lever engages a projection extending from a face of said switch means so as to achieve substantially point contact between said lever and said switch means.

11. A regulator according to claim 1, wherein said cam means includes a rotatable cam member, a mounting plate carrying a relatively rotatable spindle is releasably secured to said body section, abutment means attached to said spindle for rotation therewith engages with complementary means of said cam member so that rotation of said spindle causes corresponding rotation of said cam member, and said abutment means and said complementary means being automatically disengageable upon separation of said mounting plate from said body section.

12. A regulator according to claim 11, wherein said cam member has a cam profile on a side surface thereof which is operable to influence an auxiliary switch, and a further cam profile on an axial end face thereof is operable to influence said connection between said switch means and said actuator part.

13. An electrical energy regulator including; a body section; an actuator attached to said body section and having a heater associated therewith, part of said actuator tending to deflect in response to energization of said heater; input and load terminals secured to said body section, said input terminal being connectable to an electrical power source, and said load terminal being connectable to means for using power from said source; switch means secured to said body section in predetermined relation to said actuator and including heater contacts and control contacts, said switch means being arranged such that said heater is energizable only when said switch means is in a first operative condition in which said heater contacts are closed, and said input and load terminals are connected through said regulator only when said switch means is in a second operative condition in which said control contacts are closed; said heater and control contacts are interconnected so that one opens as the other closes, and vice versa; lever means acting between said actuator and said switch means and being responsive to pressure applied thereto by said actuator part to cause said switch means to change from one said operative condition to the other; an adjustable fulcrum against which said lever means reacts when said pressure is applied thereto; and cam means movably mounted on said body section and being operable to adjust the position of said fulcrum relative to said actuator and to thereby alter the pressure necessary between said actuator and said lever means to cause said change in operative condition of said switch means.

14. A regulator according to claim 13, wherein an auxiliary switch carried by said body section forms part of a conductive path between said input terminal and both said heater and control contacts, such that said heater is energizable and said input and load terminals are connectable only when said auxiliary switch is closed, and said cam means controls opening and closing of said auxiliary switch.

15. An electrical circuit including, a regulator according to claim 13, a power source connected to said input terminal of said regulator and a load device connected to said load terminal of the regulator.

* * * * *